US011342153B2

(12) United States Patent
Kim et al.

(10) Patent No.: US 11,342,153 B2
(45) Date of Patent: May 24, 2022

(54) FIELD EMISSION DEVICE

(71) Applicant: Electronics and Telecommunications Research Institute, Daejeon (KR)

(72) Inventors: Jae-Woo Kim, Daejeon (KR); Yoon-Ho Song, Daejeon (KR); Eun Sol Ko, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 17/201,629

(22) Filed: Mar. 15, 2021

(65) Prior Publication Data

US 2021/0305002 A1 Sep. 30, 2021

(30) Foreign Application Priority Data

Mar. 24, 2020 (KR) ..... 10-2020-0035616

(51) Int. Cl.

| | |
|---|---|
| ***H01J 29/62*** | (2006.01) |
| ***H01J 29/48*** | (2006.01) |
| ***H01J 29/04*** | (2006.01) |
| ***H01J 1/30*** | (2006.01) |
| ***H01J 1/304*** | (2006.01) |

(52) U.S. Cl.

CPC ..... *H01J 29/62* (2013.01); *H01J 1/30* (2013.01); *H01J 1/304* (2013.01); *H01J 29/04* (2013.01); *H01J 29/481* (2013.01)

(58) Field of Classification Search

CPC .... H01J 1/30–3048; H01J 29/04; H01J 29/62; H01J 29/481

See application file for complete search history.

(56) References Cited

U.S. PATENT DOCUMENTS

| | | | | |
|---|---|---|---|---|
| 7,442,926 | B2 | 10/2008 | Han et al. | |
| 8,257,566 | B2 * | 9/2012 | Farrow | C25D 13/20 204/450 |
| 9,153,407 | B2 | 10/2015 | Jeong et al. | |
| 2010/0148656 | A1 | 6/2010 | Kim | |
| 2018/0247787 | A1 | 8/2018 | Jeong et al. | |

FOREIGN PATENT DOCUMENTS

| | | | | |
|---|---|---|---|---|
| JP | 2017228488 | A * | 12/2017 | |
| KR | 10-2007-0021711 | | 2/2007 | |
| KR | 10-0679613 | | 2/2007 | |
| KR | 10-2008-0104909 | | 12/2008 | |
| KR | 10-1415745 | | 7/2014 | |
| WO | WO-2011055521 | A * | 5/2011 | H01J 27/26 |

* cited by examiner

*Primary Examiner* — Mariceli Santiago

(74) *Attorney, Agent, or Firm* — Kile Park Reed & Houtteman PLLC

(57) ABSTRACT

Provided is a field emission device including a cathode electrode and an anode electrode, which are spaced apart from each other, an emitter disposed on the cathode electrode, a gate electrode disposed between the cathode electrode and the anode electrode and including a gate opening that overlaps the emitter, and a plurality of alignment electrodes disposed between the gate electrode and the cathode electrode. Here, the alignment electrodes surround a side surface of the emitter.

14 Claims, 9 Drawing Sheets

FIELD EMISSION DEVICE

CROSS-REFERENCE TO RELATED APPLICATIONS

This U.S. non-provisional patent application claims priority under 35 U.S.C. § 119 of Korean Patent Application No. 10-2020-0035616, filed on Mar. 24, 2020, the entire contents of which are hereby incorporated by reference.

BACKGROUND

The present disclosure herein relates to a field emission device.

A principle of field emission is that an electron is extracted from a material to the outside when a strong electric field is applied to the emitter. In general, a performance of the emitter is determined by a work function of a material and a geometrical structure having a high aspect ratio.

Focusing of an electron beam is important in an industrial X-ray inspection apparatus, and since a central portion of the electron beam has a high electron density, the central portion may be aligned toward an X-ray target (e.g., a vertical direction).

However, since the emitter having the high aspect ratio is hardly aligned in the vertical direction during a manufacturing process, the emitter is mainly manufactured in an inclined state on a cathode electrode. Thus, the emitter has to be properly aligned to a central portion of gate-focusing electrodes.

SUMMARY

The present disclosure provides a field emission device having an improved focusing performance.

An embodiment of the inventive concept provides a field emission device including: a cathode electrode and an anode electrode, which are spaced apart from each other; an emitter disposed on the cathode electrode; a gate electrode disposed between the cathode electrode and the anode electrode and including a gate opening that overlaps the emitter; and a plurality of alignment electrodes disposed between the gate electrode and the cathode electrode. Here, the alignment electrodes surround a side surface of the emitter.

In an embodiment, each of the alignment electrodes may be individually connected to a ground power, or a positive voltage or a negative voltage may be applied to each of the alignment electrodes.

In an embodiment, the emitter may include a lower end fixed to a top surface of the cathode electrode and an upper end extending from the lower end in a line shape, a positive voltage may be applied to at least one of the alignment electrodes, and the upper end of the emitter may be moved toward the alignment electrode to which the positive voltage is applied.

In an embodiment, the field emission device may further include at least one focusing electrode disposed between the anode electrode and the gate electrode, and the focusing electrode may include a focusing electrode opening that overlaps the gate opening in a vertical direction.

In an embodiment, a position of the upper end of the emitter may be changed according to kinds and levels of voltages applied to the alignment electrodes.

In an embodiment, in terms of a plane, the alignment electrodes may include a first alignment electrode and a second alignment electrode, which are spaced apart from each other with the emitter therebetween in a first direction.

In an embodiment, in terms of the plane, the alignment electrodes may further include a third alignment electrode and a fourth alignment electrode, which are spaced apart from each other with the emitter therebetween in a second direction crossing the first direction.

In an embodiment of the inventive concept, a field emission device includes: a cathode electrode and an anode electrode, which are spaced apart from each other; an emitter disposed on the cathode electrode; a gate electrode disposed between the cathode electrode and the anode electrode and including an opening that overlaps the emitter; and an alignment electrode disposed between the gate electrode and the cathode electrode. Here, a position of an upper end of the emitter is changed according to a voltage applied to the alignment electrode.

In an embodiment, a positive voltage or a negative voltage may be applied to the alignment electrode.

In an embodiment, a positive voltage may be applied to the alignment electrode, and the alignment electrode, to which the positive voltage is applied, may apply an attractive force to the emitter.

In an embodiment, a negative voltage may be applied to the alignment electrode, and the alignment electrode, to which the negative voltage is applied, may apply a repulsive force to the emitter.

In an embodiment, the alignment electrode may not overlap the opening of the gate electrode in a vertical direction.

In an embodiment, the emitter may emit an electron beam passing through the opening of the gate electrode, and a position of a central line of the electron beam passing through the opening may be changed according to the position change of the upper end of the emitter.

In an embodiment, a level of a top surface of the alignment electrode may be equal to or less than that of an uppermost end of the emitter.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Exemplary embodiments of the present invention will be described with reference to the accompanying drawings so as to sufficiently understand constitutions and effects of the present invention. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. In addition, the sizes of the elements and the relative sizes between elements may be exaggerated for further understanding of the present invention.

Unless terms used in embodiments of the present invention are differently defined, the terms may be construed as meanings that are commonly known to a person skilled in the art. Hereinafter, the present invention will be described in detail by explaining preferred embodiments of the invention with reference to the attached drawings.

Figure 1A:
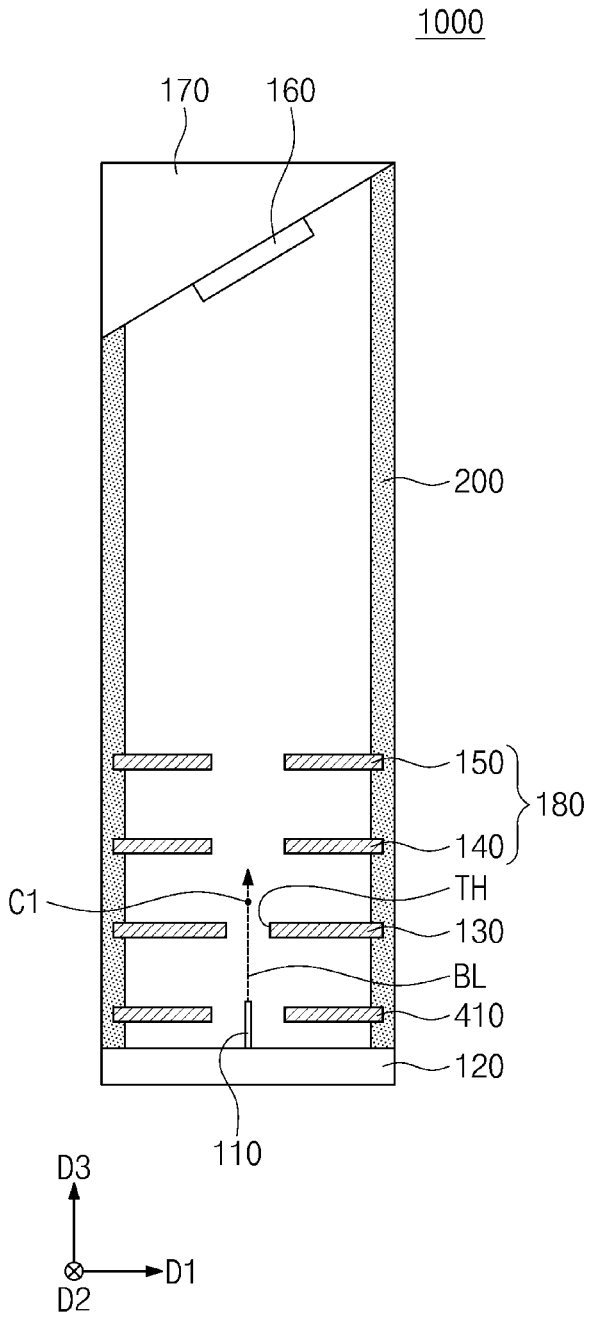
FIG. 1A is a schematic view illustrating a field emission device according to an embodiment of the inventive concept.
Figure 1B:
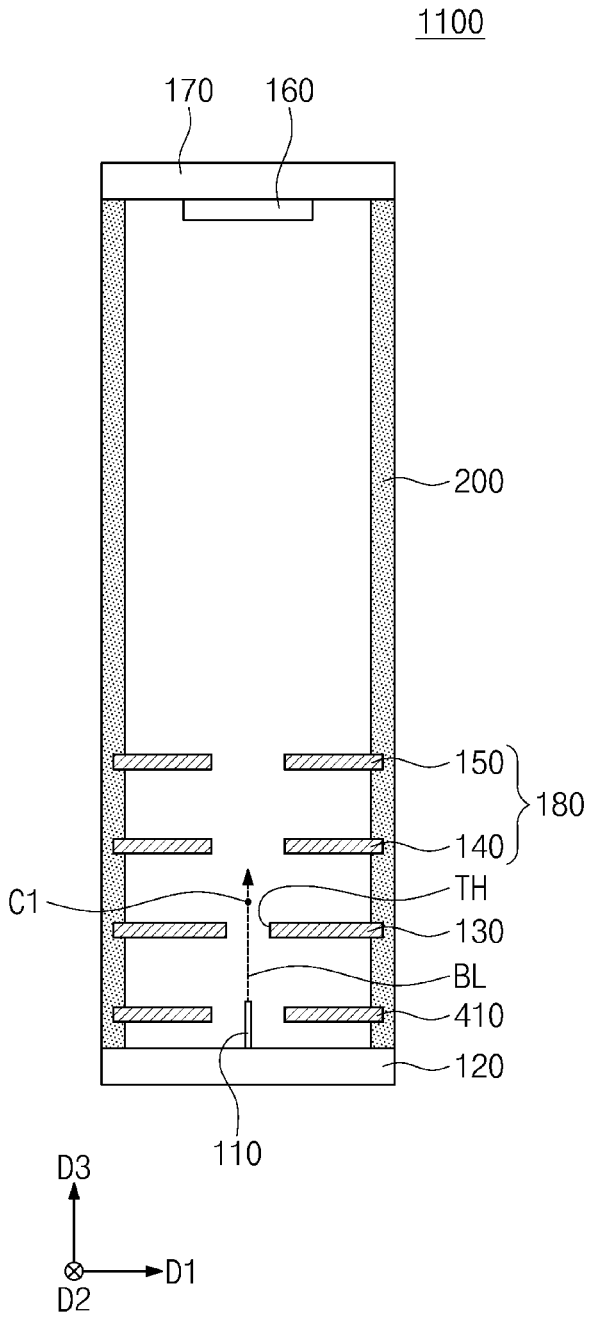
FIG. 1B is a schematic view illustrating a field emission device according to an embodiment of the inventive concept.
Figure 2:
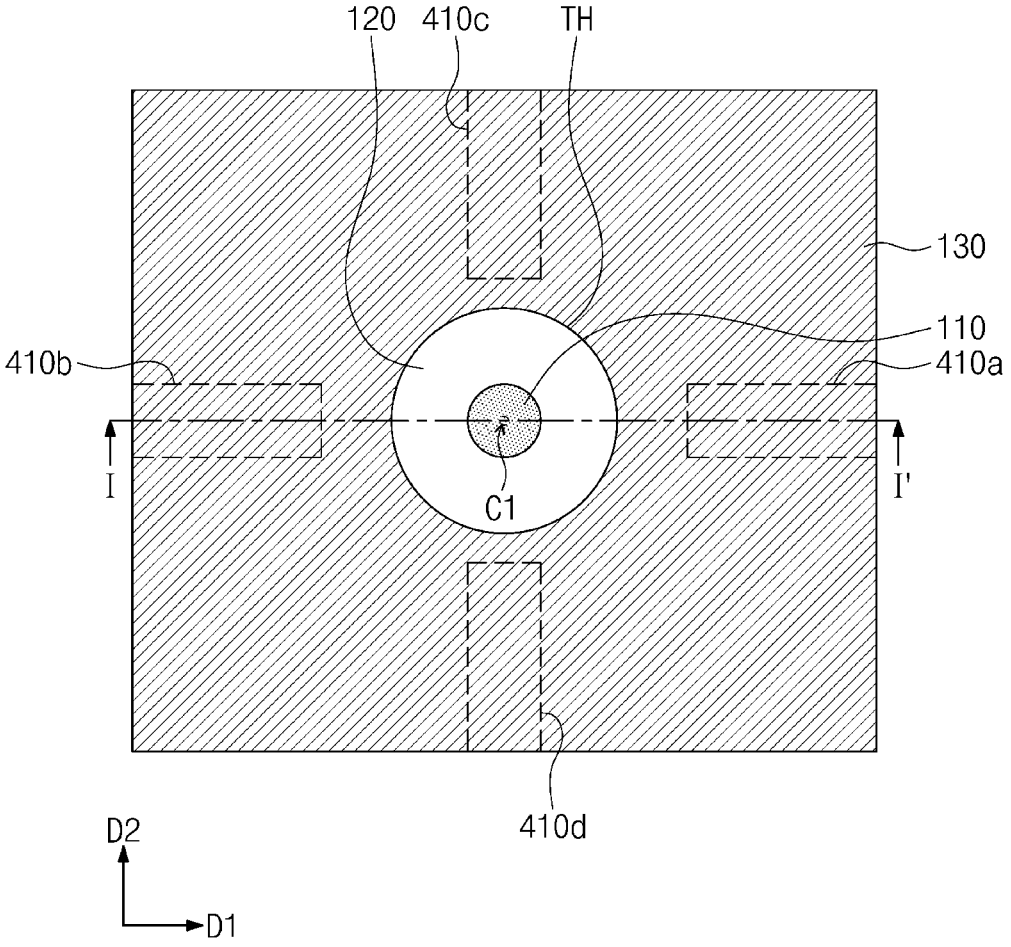
FIG. 2 is a top plan view illustrating alignment electrodes and an emitter.
Figure 3:
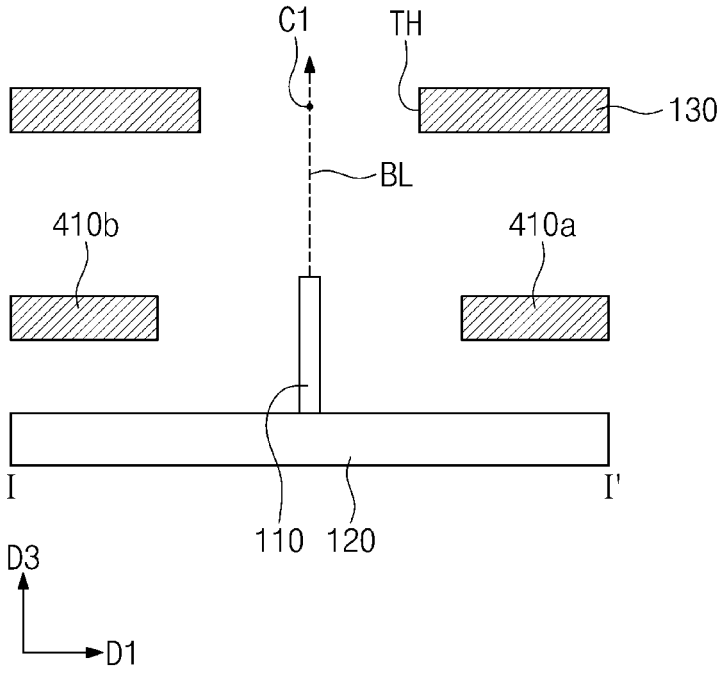
FIG. 3 is a cross-sectional view taken along line I-I' of FIG. 2.

FIG. 1A is a schematic view illustrating a field emission device according to an embodiment of the inventive concept. FIG. 1B is a schematic view illustrating a field emission device according to an embodiment of the inventive concept. FIG. 2 is a top plan view illustrating alignment electrodes and an emitter. FIG. 3 is a cross-sectional view taken along line I-I' of FIG. 2.

Referring to FIG. 1A, a field emission device 1000 according to an embodiment of the inventive concept may include a cathode electrode 120, an anode electrode 170, a target 160, a gate electrode 130, an emitter 110, a focusing electrode 180, and an insulation member 200.

Hereinafter, in this specification, a first direction D1 is defined as a direction parallel to a top surface of the cathode electrode 120. A second direction D2 is defined as a direction parallel to the top surface of the cathode electrode 120 and perpendicular to the first direction D1. A third direction D2 is defined as a direction perpendicular to the top surface of the cathode electrode 120.

The cathode electrode 120 and the anode electrode 170 may be spaced apart from each other in the third direction D3. The cathode electrode 120 and the anode electrode 170 may overlap each other in a vertical direction. The cathode electrode 120, the anode electrode 170, and the gate electrode 130 may be electrically connected to an external power (not shown).

For example, a positive voltage or a negative voltage may be applied to the cathode electrode 120, or a ground power may be connected to the cathode electrode 120. A voltage having a potential relatively higher than that of a voltage source connected to the cathode electrode 120 may be applied to the anode electrode 170 and the gate electrode 130. The anode electrode 170 may have an inclined bottom surface. The target 160 may be disposed on the bottom surface of the anode electrode 170. The target 160 may be a material emitting an X-ray when colliding with an electron beam. For example, the target 160 may include at least one of molybdenum (Mo), tantalum (Ta), tungsten (W), copper (Cu), and gold (Au). The X-ray may progress by being reflected on the inclined bottom surface of the anode electrode 170.

As illustrated in FIG. 1B, a field emission device 1100 according to an embodiment may include an anode electrode 170 having a bottom surface parallel to a top surface of a cathode electrode 120. An X-ray may transmit through the anode electrode 170 and progress in the same or similar direction as that of an electron beam.

A gate electrode 130 may be disposed between the cathode electrode 120 and the anode electrode 170. The gate electrode 130 may be disposed closer to the cathode electrode 120 than the anode electrode 170. Although each of the cathode electrode 120, the anode electrode 170, and the gate electrode 130 may have a circular plate shape in an embodiment, the embodiment of the inventive concept is not limited thereto. The gate electrode 130 may include at least one gate opening TH passing therethrough. In an embodiment, the gate electrode may include a plurality of gate openings TH.

An emitter 110 may be disposed on the cathode electrode 120. The emitter 110 may include a lower end fixed to the top surface of the cathode electrode 120 and an upper end extending from the lower end in a line shape. The emitter 110 may be a carbon nano-tube, a yarn obtained by twisting bundles of carbon nano-tubes, or a carbon-based fiber. The carbon nano-tube may have a tube shape having an inner hollow and in which carbons are connected in a hexagonal shape. However, the embodiment of the inventive concept is not limited to the material of the emitter 110. For example, the emitter 110 may include a one-dimensional nano-wire having a great aspect ratio.

The emitter 110 may emit an electron and/or an electron beam by an electric field provided by a voltage applied to the cathode electrode 120, the anode electrode 170, and the gate electrode 130. The electron and/or the electron beam emitted from the emitter 110 may be generated and accelerated in a vacuum state. In order to make the vacuum state, the field emission device 1000 may be manufactured to have a completely sealed state. Alternatively, the inside of the field emission device 1000 may have a vacuum state through a vacuum pump (not shown) connected to the outside. An insulation member 200 may include a material that is rigid even in a vacuum state. For example, the insulation member 200 may include glass or inorganic compound-based ceramics such as aluminum oxide and aluminum nitride.

The insulation member 200 may be disposed between the cathode electrode 120 and the anode electrode 170. The insulation member 200 may electrically insulate the cathode electrode 120, the anode electrode 170, and the gate electrode 130 from each other. The insulation member 200 may be a vacuum and/or insulation spacer. In an embodiment, the insulation member 200 may have one end connected to the top surface of the cathode electrode 120 and the other end connected the bottom surface of the anode electrode 170. Although the insulation member 200 may have a tube shape having opened upper and lower portions, the embodiment of the inventive concept is not limited thereto. The insulation member 200 may be connected to the gate electrode 130. For example, the insulation member 200 may surround the gate electrode 130. The insulation member 200 may include an insulating material.

A focusing electrode 180 may be disposed between the gate electrode 130 and the anode electrode 170. The focusing electrode 180 may focus electrons by applying a potential relative to that of another electrode. For example, the focusing electrode 180 may provide an electric field to distort a path of an electron beam emitted from the emitter 110. Thus, the electron beam may be focused. The focusing electrode 180 may be disposed between the gate electrode 130 and the anode electrode 170. In an embodiment, the focusing electrode 180 may include a first focusing electrode 140 and a second focusing electrode 150. The first focusing electrode 140 and the second focusing electrode 150 may be spaced apart from each other in the third direction D3. In another example, only one focusing electrode 180 may be provided.

Each of the first focusing electrode 140 and the second focusing electrode 150 may have a circular plate shape. Each of the first focusing electrode 140 and the second focusing electrode 150 may include an opening, and the opening of the first focusing electrode 140 and the opening of the second focusing electrode 150 may overlap the opening TH of the gate electrode 130 in a vertical direction. Each of the first focusing electrode 140 and the second focusing electrode 150 may be connected to an external power (not shown).

Each of the cathode electrode 120, the gate electrode 130, the anode electrode 170, and the focusing electrode 180 may include a conductive material. For example, each of the cathode electrode 120, the gate electrode 130, the anode electrode 170, and the focusing electrode 180 may include an alloy material such as stainless steel (SUS) and Kovar and a metal material such as copper (Cu), aluminum (Al), and molybdenum (Mo). Alignment electrodes 410 may be disposed between the cathode electrode 120 and the gate electrode 130. Unlike as illustrated, a position of the alignment electrodes 410 may be changed instead of being limited to a specific electrode.

The alignment electrode 410 may surround a side surface of the emitter 110. A level of a top surface of the alignment electrode 410 may be equal to or less than that of an uppermost end of the emitter 110. The alignment electrodes 410 may move an upper end of the emitter 110 by applying an electrical force.

The alignment electrodes 410 may be connected to an external power (not shown), and an individual voltage may be applied to each of the alignment electrodes 410. Although each of the alignment electrodes 410 has a rectangular shape on a plane, the embodiment of the inventive concept is not limited thereto. For example, each of the alignment electrodes 410 may have a circular shape or a tetrahedral shape. A positive voltage or a negative voltage may be applied to each of the alignment electrodes 410. Each of the alignment electrodes 410 may include a conductive material, e.g., copper (Cu), aluminium (Al), and molybdenum (Mo).

The alignment electrodes 410 may include a first alignment electrode 410*a*, a second alignment electrode 410*b*, a third alignment electrode 410*c*, and a fourth alignment electrode 410*d*.

In terms of a plane, the first alignment electrode 410*a* and the second alignment electrode 410*b* may be spaced apart from each other with the emitter 110 and the opening TH of the gate electrode 130 therebetween. The third alignment electrode 410*c* and the fourth alignment electrode 410*d* may be spaced apart from each other with the emitter 110 and the opening TH of the gate electrode 130 therebetween.

The electron beam emitted from the emitter 110 may have an electron density that is greatest around a central line BL thereof. When the central line BL of the electron beam passes a central portion C1 of the opening TH of the gate electrode 130, the electron beam may be focused to the target.

Figure 4:
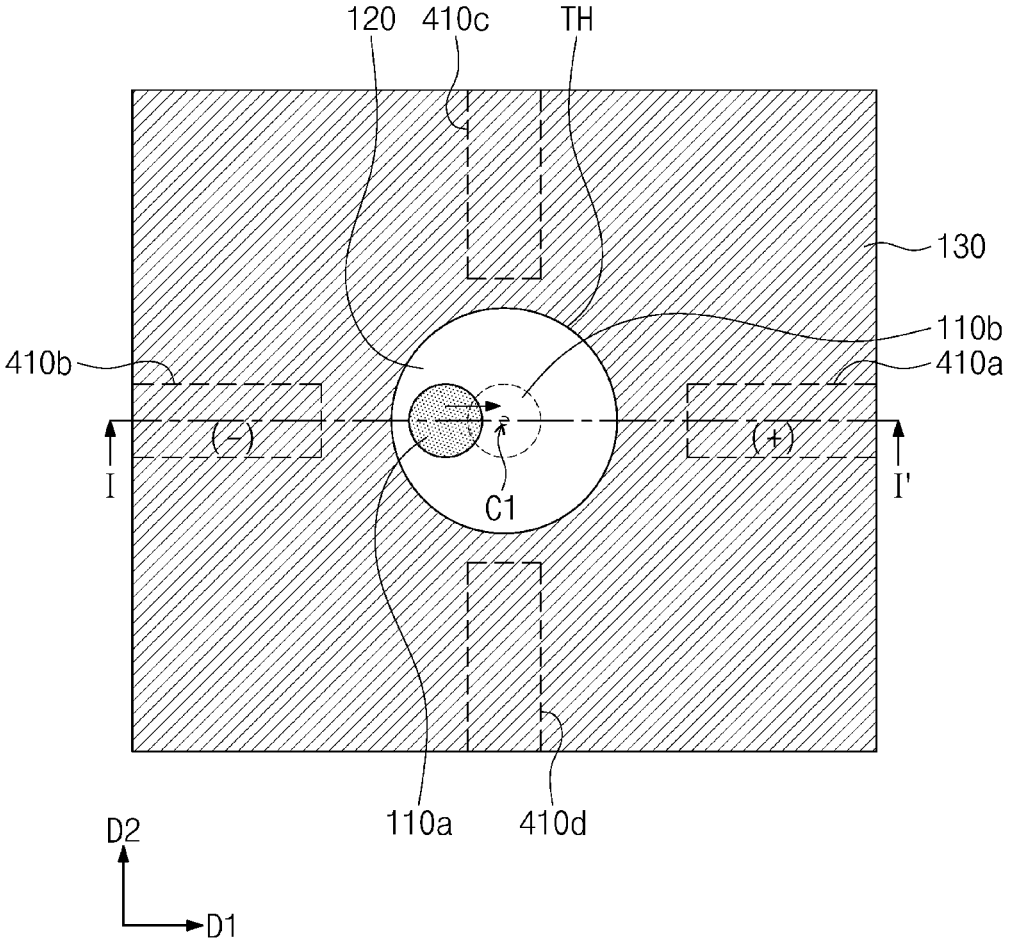
FIG. 4 is a top plan view illustrating alignment electrodes and an emitter when a voltage is applied to the alignment electrode according to an embodiment.
Figure 5:
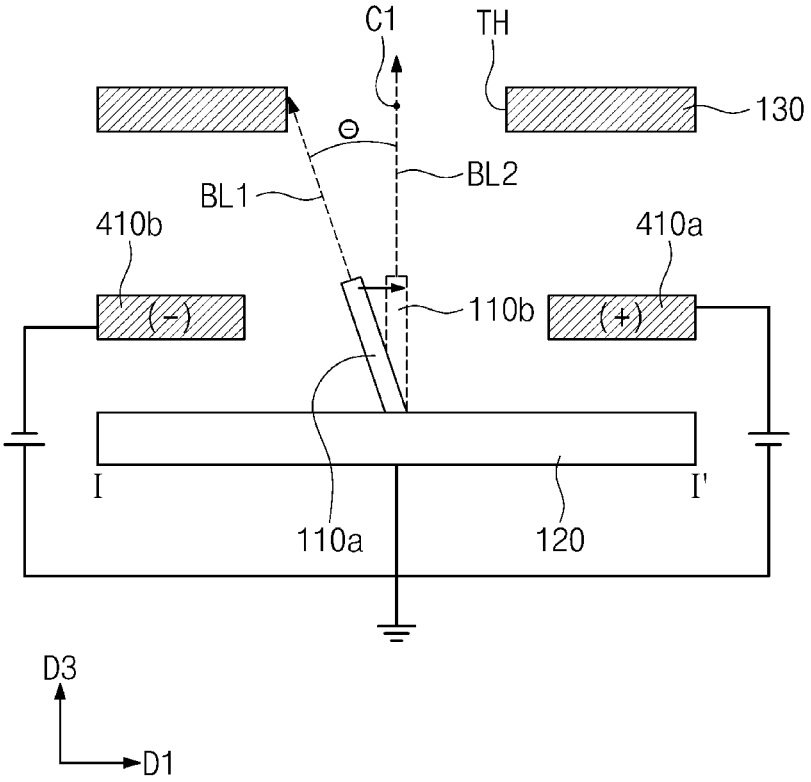
FIG. 5 is a cross-sectional view taken along line I-I' of FIG. 4.
Figure 6:
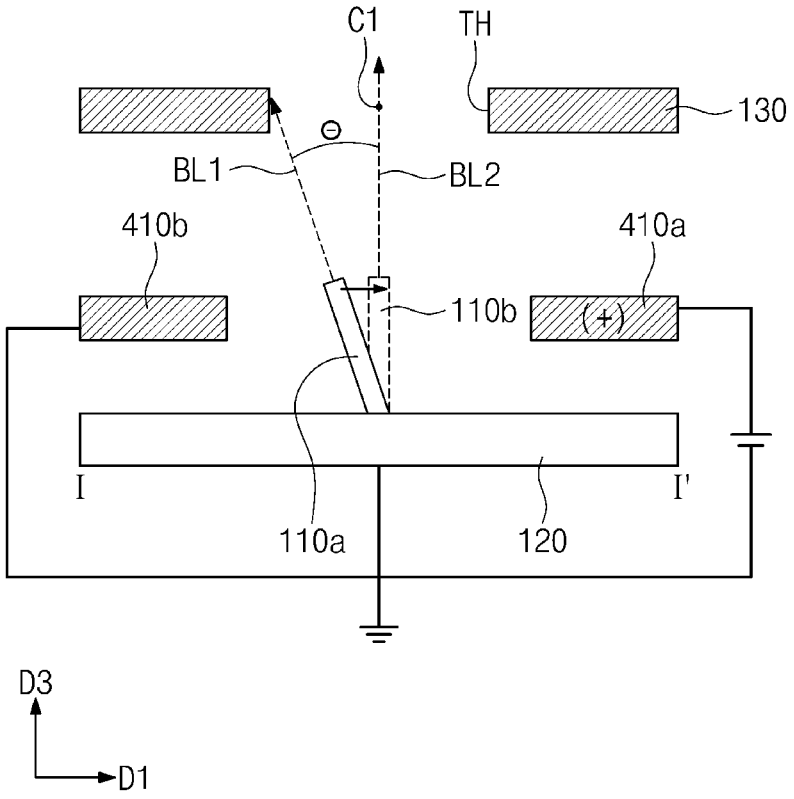
FIG. 6 is a cross-sectional view taken along line I-I' of FIG. 4.

FIG. 4 is a top plan view illustrating alignment electrodes and an emitter when a voltage is applied to the alignment electrode according to an embodiment. FIG. 5 is a cross-sectional view taken along line I-I' of FIG. 4. FIG. 6 is a cross-sectional view taken along line I-I' of FIG. 4.

Hereinafter, an emitter 110 in a misaligned initial state is referred to as a first emitter 110*a*, and a realigned emitter 110 is referred to as a second emitter 110*b*.

Referring to FIGS. 4 and 5, an upper end of the first emitter 110*a* may be inclined in the first direction D1. In terms of a plane, the upper end of the first emitter 110*a* may be disposed closer to a second alignment electrode 410*b* than a first alignment electrode 410*a*. A central line BL1 of an electron beam emitted from the first emitter 110*a* may not pass a central portion C1 of an opening TH of a gate electrode 130.

A positive voltage may be applied to the first alignment electrode 410*a*, a negative voltage may be applied to the second alignment electrode 410*b*, and a ground power may be connected to a cathode electrode 120. In this case, as an electrical force acts on the first emitter 110*a*, the upper end of the first emitter 110*a* may be moved. Specifically, the first alignment electrode 410*a* to which the positive voltage is applied may apply an attractive force to the emitter 110, and the second alignment electrode 410*b* to which the negative voltage is applied may apply a repulsive force to the emitter 110.

As the upper end of the first emitter 110*a* is moved by receiving a physical external force, the first emitter 110*a* may be converted into the second emitter 110*b*. The second emitter 110*b* may have an upper end extending in the third direction D3. A central line BL2 of an electron beam emitted from the second emitter 110*b* may pass the central portion C1 of the opening TH of the gate electrode 130. The central line BL1 of the electron beam emitted from the first emitter 110*a* and the central line BL2 of the electron beam emitted from the second emitter 110*b* may provide an inclination θ.

Since the emitter 110 is not properly aligned in a vertical direction during a manufacturing process due to a high aspect ratio of the emitter 110, the emitter 110 is frequently manufactured in an inclined state on the top surface of the cathode electrode 120. According to an embodiment of the inventive concept, the inclined emitter 110 may be realigned in the vertical direction by applying a voltage to the alignment electrode 410 disposed at the side surface of the emitter 110. In this case, the central line BL of the electron beam of the emitter 110 may pass the central portion C1 of the opening TH of the gate electrode 130.

Although the voltage is applied to only the first alignment electrode 410*a* and the second alignment electrode 410*b* in FIGS. 4 and 5, the voltage may be also applied to a third alignment electrode 410*c* and a fourth alignment electrode 410*d*. The voltage applied to the first to fourth alignment electrode 410*a* to 410*d* may apply a physical force to the first emitter 110*a*, and when the voltage is adjusted by calculating a vector sum of each of voltages, even the first emitter 110*a* that is distorted in a complex manner may be aligned and converted into the second emitter 110*b*.

Referring to FIG. 6, the positive voltage may be selectively applied to only the first alignment electrode 410*a*, and the ground power may be connected to the second alignment electrode 410*b* and the cathode electrode 120. A potential difference may exist between the first alignment electrode 410*a* and the first emitter 110*a*, and an attractive force may be applied between the first alignment electrode 410*a* and the first emitter 110*a*. As the upper end of the first emitter 110*a* is moved, the first emitter 110*a* may be aligned and converted into the second emitter 110*b*.

Figure 7:
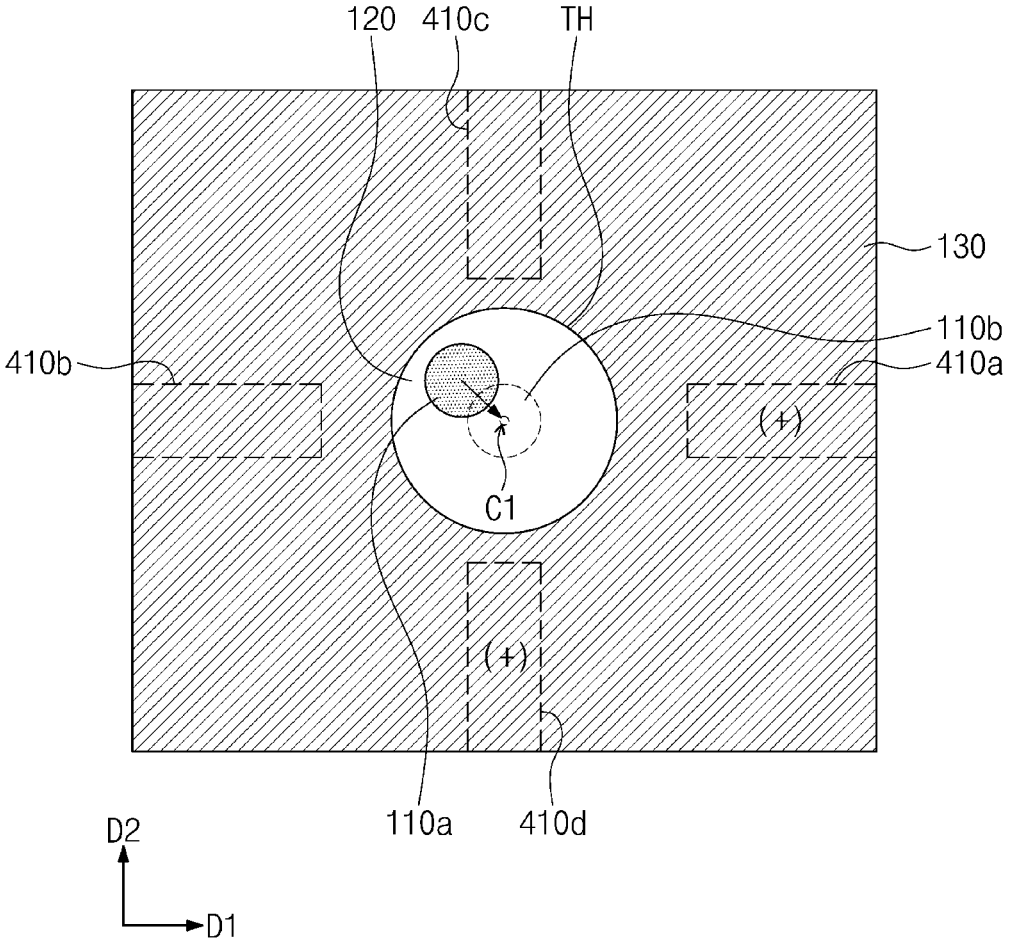
FIG. 7 is a top plan view illustrating alignment electrodes and an emitter when a voltage is applied to the alignment electrode according to an embodiment.

FIG. 7 is a top plan view illustrating alignment electrodes and an emitter when a voltage is applied to the alignment electrode according to an embodiment.

Referring to FIG. 7, an upper end of a first emitter 110*a* may be spaced apart from a central portion C1 of an opening TH of a gate electrode 130 in the first direction D1 and the second direction D2. The upper end of the first emitter 110*a* may be disposed adjacent to a second alignment electrode 410*b* and a third alignment electrode 410*c* and disposed relatively away from a first alignment electrode 410*a* and a fourth alignment electrode 410*d*. A positive voltage may be applied to the first alignment electrode 410*a* and the fourth alignment electrode 410*d*. In this case, as the upper end of the first emitter 110*a* receives an electrical attractive force and is moved toward the first alignment electrode 410*a* and the fourth alignment electrode 410*d*, the first emitter 110*a* may be aligned and converted into the second emitter 110*b*.

Figure 8:
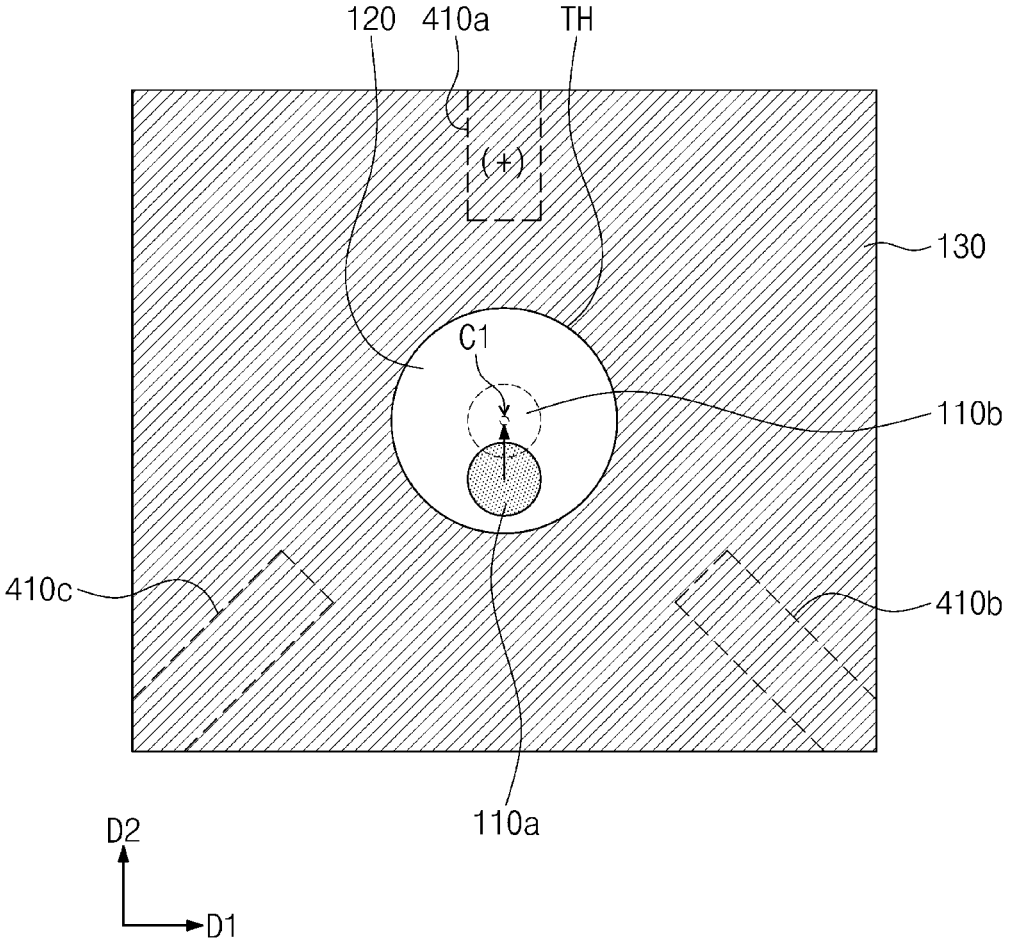
FIG. 8 is a top plan view illustrating alignment electrodes and an emitter when a voltage is applied to the alignment electrode according to an embodiment.

FIG. 8 is a top plan view illustrating alignment electrodes and an emitter when a voltage is applied to the alignment electrode according to an embodiment.

Referring to FIG. 8, alignment electrodes 410 may include a first alignment electrode 410*a*, a second alignment electrode 410*b*, and a third alignment electrode 410*c*, which are arranged in a clockwise direction with respect to a central portion C1 of an opening TH of a gate electrode 130. The first alignment electrode 410*a*, the second alignment electrode 410*b*, and the third alignment electrode 410*c* may be arranged by about 120° with respect to a central portion C1 of an opening TH of a gate electrode 130.

For example, an upper end of a first emitter 110*a* may be spaced apart from the central portion C1 of the opening TH of the gate electrode 130 in the second direction D2. The upper end of the first emitter 110*a* may be disposed adjacent to the second alignment electrode 410*b* and the third alignment electrode 410*c* and disposed relatively away from the first alignment electrode 410*a*. Here, when a positive voltage is applied to the first alignment electrode 410*a*, the upper end of the first emitter 110*a* may be moved toward the first alignment electrode 410*a*, and aligned and converted into a second emitter 110*b*.

The field emission device according to an embodiment of the inventive concept may cause a physical shape deformation on the upper end of the emitter by using the alignment electrode surrounding the side surface of the emitter. As the inclined emitter may be vertically aligned, the central line of the electron beam may pass through the central portion of the opening of the gate electrode.

According to the embodiment of the inventive concept, the emitter may be realigned through the alignment electrode even when the alignment of the emitter is distorted because arcing is generated inside or outside an element during an operation process in addition to the case when the emitter is misaligned in an initial manufacturing state.

According to the embodiment of the inventive concept, the initial arrangement of the emitter may be physically realigned through the alignment electrode. As the central portion of the electron beam having the high electron density, which is emitted from the realigned emitter, passes through the central portion of the gate electrode, the electron beam having the high density may be focused to the target. As a result, the focusing performance of the field emission device may be maximized.

Although the embodiments of the present invention have been described, it is understood that the present invention should not be limited to these embodiments but various changes and modifications can be made by one ordinary skilled in the art within the spirit and scope of the present invention as hereinafter claimed. Thus, the above-disclosed embodiments are to be considered illustrative and not restrictive.

What is claimed is:

1. A field emission device comprising:

a cathode electrode and an anode electrode, which are spaced apart from each other;

an emitter disposed on the cathode electrode;

a gate electrode disposed between the cathode electrode and the anode electrode and comprising a gate opening that overlaps the emitter; and a plurality of alignment electrodes disposed between the gate electrode and the cathode electrode, wherein the alignment electrodes surround a side surface of the emitter.

2. The field emission device of claim 1, wherein each of the alignment electrodes is individually connected to a ground power, or a positive voltage or a negative voltage is applied to each of the alignment electrodes.

3. The field emission device of claim 2, wherein the emitter comprises a lower end fixed to a top surface of the cathode electrode and an upper end extending from the lower end in a line shape, a positive voltage is applied to at least one of the alignment electrodes, and the upper end of the emitter is moved toward the alignment electrode to which the positive voltage is applied.

4. The field emission device of claim 1, further comprising at least one focusing electrode disposed between the anode electrode and the gate electrode, wherein the focusing electrode comprises a focusing electrode opening that overlaps the gate opening in a vertical direction.

5. The field emission device of claim 1, wherein a position of the upper end of the emitter is changed according to kinds and levels of voltages applied to the alignment electrodes.

6. The field emission device of claim 1, wherein in terms of a plane, the alignment electrodes comprise a first alignment electrode and a second alignment electrode, which are spaced apart from each other with the emitter therebetween in a first direction.

7. The field emission device of claim 6, wherein in terms of the plane, the alignment electrodes further comprise a third alignment electrode and a fourth alignment electrode, which are spaced apart from each other with the emitter therebetween in a second direction crossing the first direction.

8. A field emission device comprising:

a cathode electrode and an anode electrode, which are spaced apart from each other;

an emitter disposed on the cathode electrode;

a gate electrode disposed between the cathode electrode and the anode electrode and comprising an opening that overlaps the emitter; and an alignment electrode disposed between the gate electrode and the cathode electrode, wherein a position of an upper end of the emitter is changed according to a voltage applied to the alignment electrode.

9. The field emission device of claim 8, wherein a positive voltage or a negative voltage is applied to the alignment electrode.

10. The field emission device of claim 9, wherein a positive voltage is applied to the alignment electrode, and the alignment electrode, to which the positive voltage is applied, applies an attractive force to the emitter.

11. The field emission device of claim 9, wherein a negative voltage is applied to the alignment electrode, and the alignment electrode, to which the negative voltage is applied, applies a repulsive force to the emitter.

12. The field emission device of claim 8, wherein the alignment electrode is not in overlap with the opening of the gate electrode in a vertical direction.

13. The field emission device of claim 8, wherein the emitter emits an electron beam passing through the opening of the gate electrode, and a position of a central line of the electron beam passing through the opening is changed according to the position change of the upper end of the emitter.

14. The field emission device of claim 8, wherein a level of a top surface of the alignment electrode is equal to or less than that of an uppermost end of the emitter.

* * * * *